US011959028B1

(12) United States Patent
Roberts et al.

(10) Patent No.: US 11,959,028 B1
(45) Date of Patent: Apr. 16, 2024

(54) DESULFURIZATION AND CONTAMINANT REDUCTION OF FUEL OIL

(71) Applicant: C3PO, LLC, Sheridan, WY (US)

(72) Inventors: Jared Roberts, Grand Junction, CO (US); Gene Dedick, Grand Junction, CO (US)

(73) Assignee: C3 PO, LLC, Sheridan, WY (US)

( * ) Notice: Subject to any disclaimer, the term of this patent is extended or adjusted under 35 U.S.C. 154(b) by 0 days.

(21) Appl. No.: 18/382,116

(22) Filed: Oct. 20, 2023

(51) Int. Cl.
*C10G 53/14* (2006.01)

(52) U.S. Cl.
CPC ..... *C10G 53/14* (2013.01); *C10G 2300/1048* (2013.01); *C10G 2300/202* (2013.01); *C10G 2300/4006* (2013.01); *C10G 2300/4012* (2013.01); *C10G 2300/4081* (2013.01); *C10G 2300/70* (2013.01)

(58) Field of Classification Search
CPC ..... C10G 17/00; C10G 17/02; C10G 17/04; C10G 17/09; C10G 17/10; C10G 21/12; C10G 21/14; C10G 21/16; C10G 21/18; C10G 21/20; C10G 21/28; C10G 27/00; C10G 27/04; C10G 27/08; C10G 27/12; C10G 53/00; C10G 53/14; C10G 2300/1048; C10G 2300/202; C10G 2300/4006; C10G 2300/4012; C10G 2300/4081; C10G 2300/70
See application file for complete search history.

(56) References Cited

U.S. PATENT DOCUMENTS

2014/0299512 A1* 10/2014 Gargano ..... C10G 27/04 208/243

* cited by examiner

*Primary Examiner* — Prem C Singh
*Assistant Examiner* — Brandi M Doyle
(74) *Attorney, Agent, or Firm* — Georgiy L. Khayet

(57) ABSTRACT

A method for desulfurization and contaminant reduction of fuel oil is provided. The method includes mixing, in a first container, the fuel oil with a first catalyst to oxidize sulfur containing compounds in the fuel oil to obtain one or more of a sulfoxide and a sulfone and oxidize metal contaminants in the fuel oil to obtain oxides of the contaminants, thereby forming a first mixture; mixing, in a second container, the first mixture with a second catalyst and a third catalyst to extract sulfur and an oxygen from the sulfoxide and the sulfone, thereby obtaining a second mixture; separating, in a vapor recovery unit, the second catalyst from the second mixture to obtain a third mixture; and separating, from the third mixture, in a mechanical separator, the third catalyst, the sulfur, and the oxide of the metal contaminants to obtain a purified fuel oil.

20 Claims, 3 Drawing Sheets

DESULFURIZATION AND CONTAMINANT REDUCTION OF FUEL OIL

TECHNICAL FIELD

This disclosure relates to a system and methods for desulfurization and contaminant reduction of fuel oil.

BACKGROUND

Fuel combustion processes are one of the main sources of sulfur dioxide emissions. Sulfur dioxide can cause the formation of sulfate aerosol particles causing adverse effects on the environment. Accordingly, the United States Environmental Protection Agency (US EPA) has established several stringent regulations for sulfur content in road transportation fuels and nonroad fossil fuels in order to control the emission. Conventional methods for extraction of sulfur compounds and other contaminants from fuel oil increases cost of fuel oil due to inefficient use of reagents during the purification process. Therefore, more efficient techniques for desulfurization and contaminant reduction of fuel oil are needed.

SUMMARY

This section is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

According to one example embodiment, a method for desulfurization and contaminant reduction of fuel oil is provided. The fuel oil can be contaminated by a sulfur containing compound and a contaminant. The method includes mixing, in a first container, the fuel oil with a first catalyst to oxidize sulfur containing compounds in the fuel oil to obtain one or more of a sulfoxide and a sulfone and oxidize metal contaminants in the fuel oil to obtain oxides of the contaminants, thereby forming a first mixture. The method may include mixing, in a second container, the first mixture with a second catalyst and a third catalyst to extract sulfur and oxygen from the sulfoxide and the sulfone, thereby obtaining a second mixture. The method may include separating, in a vapor recovery unit, the second catalyst from the second mixture to obtain a third mixture. The method may include separating, from the third mixture, in a mechanical separator, the third catalyst, the sulfur, and the oxide of the contaminant to obtain a purified fuel oil.

The method may include after separating the second catalyst, providing the second catalyst from the vapor recovery unit to the second container. The method may include collecting, in a third container, a combination of the third catalyst and the sulfur from a lower portion of the mechanical separator. The method may include washing out the sulfur from the combination of the third catalyst and the sulfur. The method may include providing the third catalyst from the third container to the second container.

The second catalyst may weaken a carbon-sulfur bond in the sulfoxide and the sulfone. The third catalyst may include polar functional groups to overcome a bond energy of the carbon-sulfur bond in the sulfoxide and the sulfone.

The second catalyst may include a solvent based catalyst including one or more of the following: alcohols and aromatics. The third catalyst may include a liquid catalyst including nitrogen, hydrogen, oxygen, copper and carbon.

The first catalyst may include a solution of hydrogen, nitrogen, and oxygen. The sulfur containing compound may include R'—S—R", where at least one of R' and R" includes one of the following: organic sulfide and a thiophanic compound.

The contaminant may include one of the following: silica, a soluble iron, aluminum, a vanadium, a nickel, and a zinc. The oxide of the contaminant may include one of the following: silicon dioxide, an iron oxide, an aluminum oxide, a vanadium pentoxide, a nickel oxide, and a zinc oxide.

The third catalyst may allow insoluble fractions of the sulfur and the oxide of the contaminant to pass through to the bottom of the mechanical separator. The third catalyst can be immiscible with the fuel oil.

The fuel oil may include micro carbons and the second catalyst may solubilize and reform the micro carbons into soluble alkanes.

Mixing the first mixture with the second catalyst and the third catalyst can be carried out at temperature between 75 Fahrenheit and 220 Fahrenheit and a pressure between −20 pounds per square inch gauge (psig) to 20 psig.

Additional objects, advantages, and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE SEVERAL VIEWS OF THE DRAWINGS

Embodiments are illustrated by way of example and not limitation in the figures of the accompanying drawings, in which like references indicate similar elements and in which.

DETAILED DESCRIPTION

Figure 1:
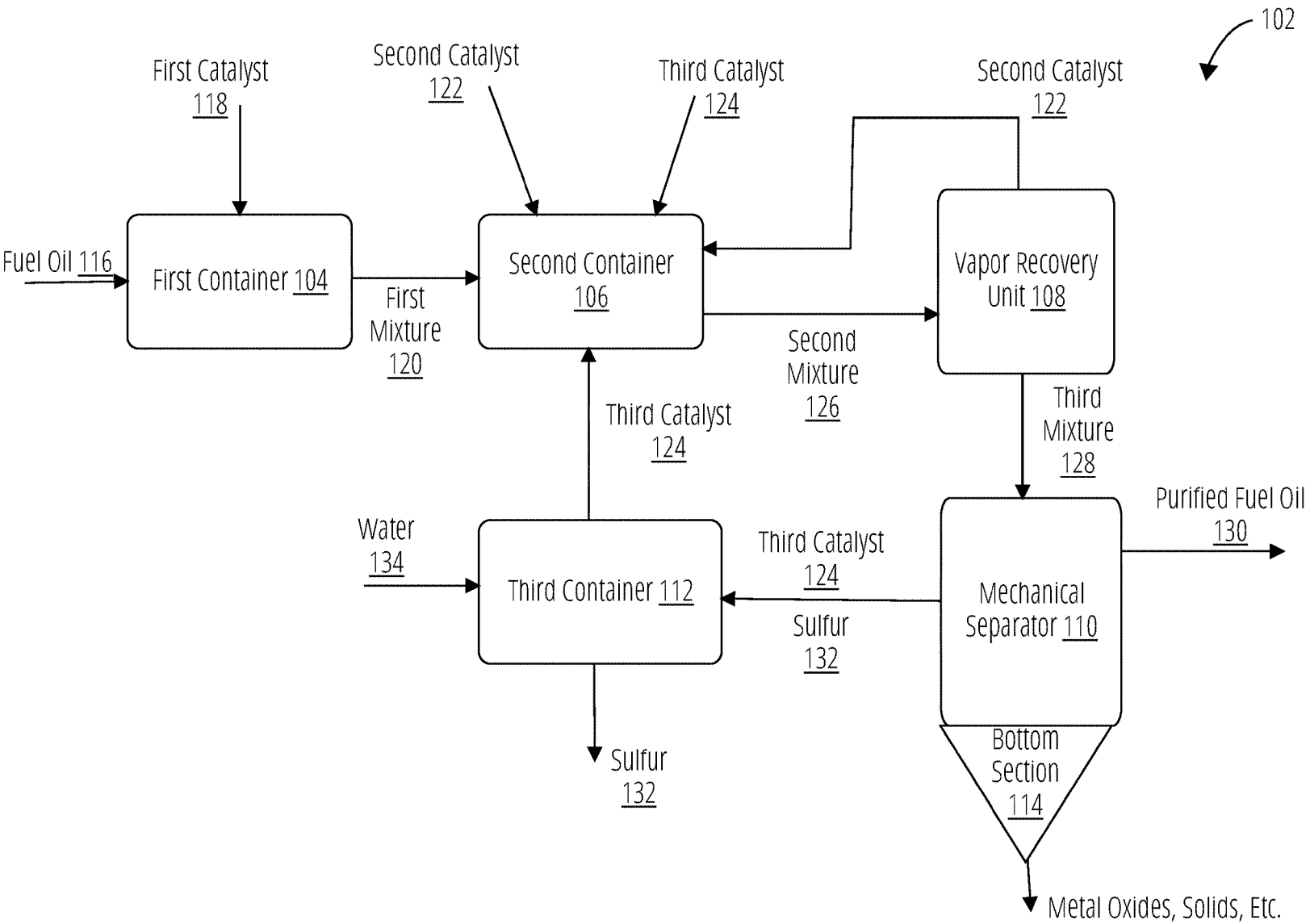
FIG. 1 illustrates a system for desulfurization and contaminant reduction of fuel oil, according to an example embodiment.

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

Generally, the embodiments of this disclosure are concerned with systems and methods for desulfurization and contaminant reduction of fuel oil, such as heavy fuel oils, high sulfur residual fuel oils, marine gas oils, marine diesel oils, diesel fuel, octane, and others. The fuel oil can be contaminated by a sulfur containing compound and contaminants. The contaminants may include a silica, a soluble iron, aluminum, a vanadium, a nickel, and a zinc. Embodiments of this disclosure may allow removing, from the fuel oil, the following compounds:

1) aliphatic sulfur (thiols and sulfides) and aromatic sulfur or thiophenics such as dibenzothiophene and its derivatives.

2) contaminants such as silica, iron, aluminum, vanadium, and other fuel performance inhibiting metals such as nickel, zinc, and others.

3) micro carbons and other organic compounds that only partially combust and evolve into excess carbon dioxide equivalents ($CO_2e$) in the combustion exhaust sent to the atmosphere when burning fuels that contain these compounds.

An example system for desulfurization and contaminant reduction of fuel oil may include a first container designed for mixing the fuel oil with a first catalyst to form a first mixture. The first catalyst can oxidize the sulfur containing compound in the fuel oil to obtain one or more of the following: a sulfoxide and a sulfone. The first catalyst can oxidize the contaminant in the fuel oil to obtain an oxide of the contaminant.

The system may include a second container designed for mixing the first mixture with a second catalyst and a third catalyst to extract sulfur and oxygen from the sulfoxide and the sulfone, thereby obtaining a second mixture. The second catalyst can weaken a carbon-sulfur bond in the sulfoxide and the sulfone. The third catalyst may include polar functional groups to overcome a bond energy of the carbon-sulfur bond in the sulfoxide and the sulfone.

The system may include a vapor recovery unit designed for separating the second catalyst from the second mixture to obtain a third mixture. The system may include a mechanical separator designed for separating, from the third mixture, the third catalyst, the sulfur, and the oxide of the contaminant to obtain a purified fuel oil.

After being separated from the second mixture, the second catalyst can be provided to the second container. The system may include a third container designed to store a combination of the third catalyst and the sulfur, with the combination being collected from a lower portion of the mechanical separator. The sulfur can be washed out from the combination of the third catalyst and the sulfur, thereby leaving solely the third catalyst in the third container. The third catalyst stored in the third container can be provided to the second container.

FIG. 1 illustrates an example system 102 for desulfurization and contaminant reduction of fuel oil, according to an example embodiment. System 102 may include a first container 104, a second container 106, a vapor recovery unit 108, a mechanical separator 110, and a third container 112. The mechanical separator 110 may include a bottom section 114.

At a first step, a fuel oil 116 and a first catalyst 118 can be mixed in the first container 104 to from a first mixture 120. The fuel oil 116 can be contaminated by sulfur containing compounds R'—S—R", such as organic sulfides and/or thiophenic compounds. The fuel oil 116 can also be contaminated by other contaminants including a silica, a soluble iron, an aluminum, a vanadium, a nickel, and a zinc. The first catalyst 118 (C3POA) can be an oxidizer, which in gaseous form includes ozone O3 and poly-hydroxides OH—OH—OH repeated in the chain. The reactions occurring in the first container 104 and forming the first mixture 120 can be described by the following formulas:

1) Sulfur Containing Compound in Fuel+C3POA>>>>Sulfoxide and/or Sulfone $$R'—S—R''+2O^{-}>>>>R'—SO_2—R'' \quad \text{(Eq. 1)}$$

2) {Silica, Soluble Iron, Aluminum, Vanadium, Nickel, Zinc etc.}+C3POA>>>>{Silicon Dioxide, Iron Oxide, Aluminum Oxide, Vanadium Pentoxide, Nickel Oxide, Zinc Oxide}

$$\{Si+2Al+2V+Ni+Zn\}+12O^{-}>>>>\{SiO_2+Al_2O_3+V_2O_5+NiO+ZnO\} \quad \text{(Eq. 2)}$$

It should be noted that sulfoxides and sulfones are more polar than their precursors. This increased polarity allows to selectively capture and remove the sulfur from the fuel in the next steps of the process of desulfurization and contaminant reduction of fuel oil. Sulfoxides and sulfones have a weaker C—S bond strength than their precursors. This weaker bond strength enables the chemical extraction described in a second step.

At the second step, the first mixture 120 is provided to second container 106. A second catalyst 122 (C3POB) and a third catalyst 124 (C3POC) can be added to the first mixture 120 to form a second mixture 126. The second catalyst 122 (C3POB) may include an 80% solution of methanol (CH3OH) in an alcohol. The third catalyst 124 (C3POC) can be prepared by mixing a solution of ethanolamine C2H8N2O3 with nitric acid HNO3 in a 1 to 1 molar ratio in the presence of the salt of an acid CuNO3 at a temperature between −44 degrees of Fahrenheit (F) and 70° F.

The second catalyst 122 and the third catalyst 124 (C3POB+C3POC) are added to extract the sulfur in an isothermal process. The second catalyst 122 (C3POB) expands the C—S bonds in sulfoxides and sulfones formed in the first step. This allows the third catalyst 124 (C3POC) to reach the proximity required to break the weakened C—S bond in the sulfoxides and sulfones. The second catalyst 122 (C3POB) also solubilizes and reforms some of the micro carbons found in the fuel oil into soluble alkanes (usable fuel) of desirable carbon chain length.

The third catalyst 124 (C3POC) utilizes its polar functional group to overcome the bond energy of the C—S bond to extract the sulfur from the sulfur bearing sulfoxides and sulfones while remaining immiscible with the fuel oil 116 in treatment. Thus, the sulfur can be separated in the next step from the fuel oil 116. The third catalyst 124 (C3POC) may also allow the insoluble fractions of sulfur to pass through itself to the bottom section 114 of the mechanical separator 110 in the third step. The reaction occurring in the second container 106 can be described by the following formula:

Sulfoxides and Sulfones+C3POB+C3POC C3POB+C3POC-Sulfur+Oxygen $$R'—SO_2—R''+C3POB+C3POC>>>>C3POB+C3POC\text{-}S+O_2 \quad \text{(Eq. 3)}$$

The oxygen produced in this reaction can oxidize an additional amount of metals in the fuel oil 116 as described in the first step.

In the third step, the second mixture 126 is provided to the vapor recovery unit 108 and further to the mechanical separator 110. In the vapor recovery unit 108, the second catalyst 122 (C3POB) is separated by vaporization from the second mixture 126 to form the third mixture 128. The third mixture 128 is provided to the mechanical separator 110. The second catalyst 122 (C3POB) is provided to the second container to be reused in the second step as described above. In some embodiments, the vapor recovery unit 108 may be carried out in a form of a closed cylinder with a condensing separator installed in the cylinder. The vapor recovery unit 108 can operate at a negative pressure and temperature or 70-100° F.

Purified fuel oil 130 can be removed from the upper portion of the mechanical separator 110. The third catalyst 124 (C3POC) can be removed from the lower portion of the mechanical separator 110 and provided to the third container 112. The third catalyst 124 may include soluble sulfur, which can be washed out from the third container 112 by a water wash. The sulfur 132 can then be separated from that water as an insoluble material for repurpose or resale. 90% to 95% of the third catalyst 124 (C3POC) can then be collected and reused in the second step when it is provided to the second container 106. Water 134 can be recycled back to the third container 112 for the third catalyst 124 (C3POC) water wash process.

The solid sulfur, silica oxides, metal oxides, remaining micro carbons, bitumen, asphaltene, ash, and other contaminants fall to, and can be removed from, the bottom section 114 of the mechanical separator 110. These solids can be separated for repurpose and resale.

The described above steps of the process for desulfurization and contaminant reduction of fuel oil can be carried out at temperatures of 75° F. and 220° F. at −20 psig to +20 psig. The temperatures and pressures can depend on the type and physical properties of the fuel oil being treated. For example, octane and diesel can be processed at a temperature from 75° F. to 85° F. and pressure from zero to 7.5 psig in the first container 104 and the second container 106. Marine gasoil (MGO) and high sulfur fuel oil (HSRFO) can be processed at a temperature between 95° F. and 200° F. and a pressure between 10 and 20 psig in the first container 104 and the second container 106. The negative pressure −20 psig can be achieved in vapor recovery unit 108.

Figure 2:
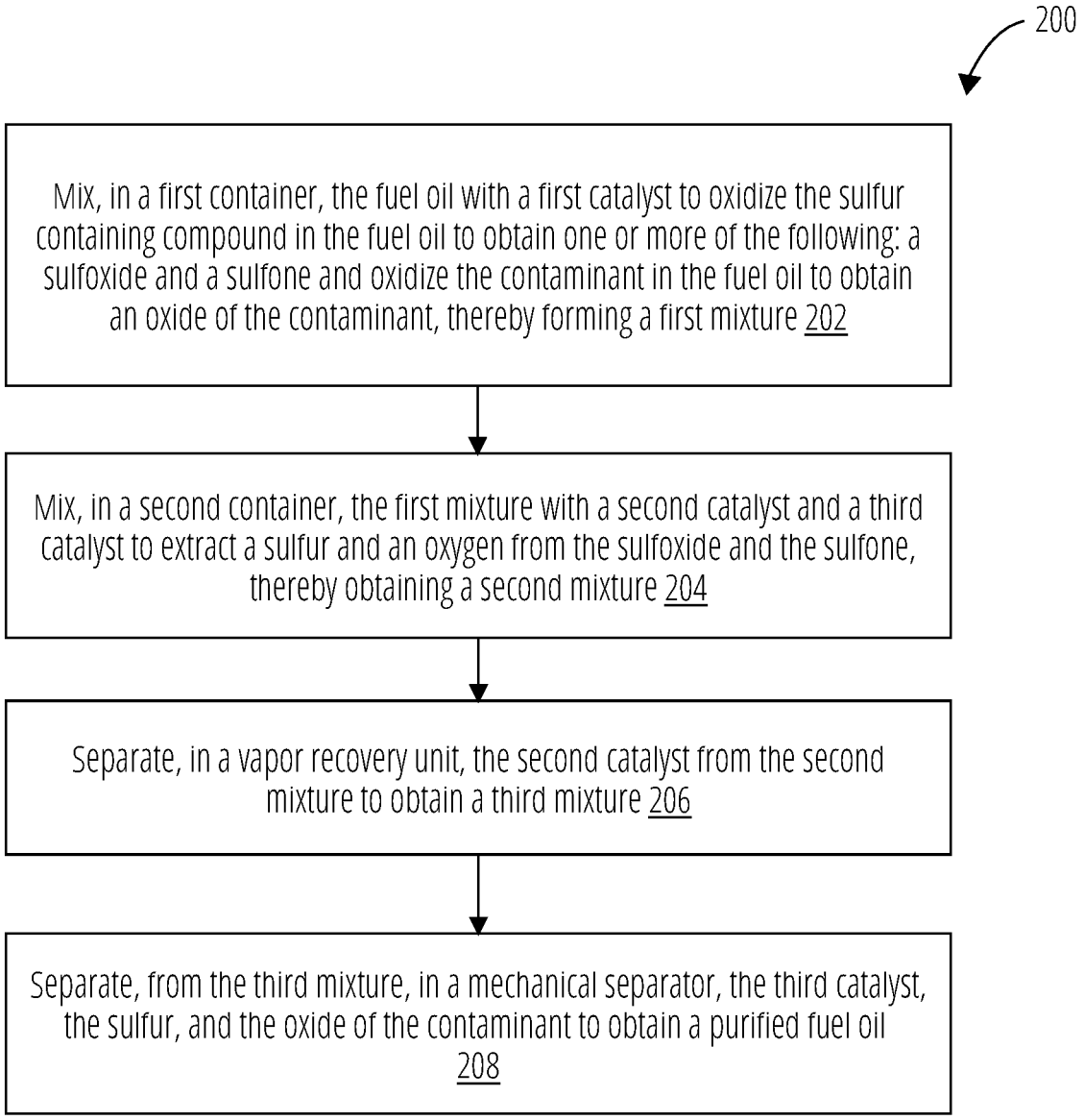
FIG. 2 illustrates an example method for desulfurization and contaminant reduction of fuel oil, according to an example embodiment.

FIG. 2 illustrates an example method 200 for desulfurization and contaminant reduction of fuel oil, according to an example embodiment. The fuel oil 116 can be contaminated by sulfur containing compounds R'—S—R", such as organic sulfides and/or thiophenic compounds. The fuel oil 116 can also be contaminated by other contaminants including a silica, a soluble iron, aluminum, a vanadium, a nickel, and a zinc. Method 200 can be implemented by system 102 shown in FIG. 1. Although example method 200 depicts a particular sequence of operations, the sequence may be altered without departing from the scope of the present disclosure. For example, some of the operations depicted may be performed in parallel or in a different sequence that does not materially affect the function of method 200. In other examples, different components of an example system 102 that implements the method 200 may perform functions at substantially the same time or in a specific sequence.

In block 202, method 200 may include mixing, in a first container, the fuel oil with a first catalyst to form a first mixture. The first catalyst oxidizes a sulfur containing compound in the fuel oil to obtain one or more of the following: a sulfoxide and a sulfone. In block 202, the first catalyst also oxidizes a contaminant in the fuel oil to obtain an oxide of the contaminant. The first catalyst may include a solution of hydrogen, nitrogen, and oxygen. The oxide of the contaminant may include one of the following: silicon dioxide, an iron oxide, an aluminum oxide, a vanadium pentoxide, a nickel oxide, and a zinc oxide.

In block 204, method 200 may include mixing, in a second container, the first mixture with a second catalyst and a third catalyst to extract sulfur and oxygen from the sulfoxide and the sulfone, thereby obtaining a second mixture. The second catalyst weakens a carbon-sulfur bond in the sulfoxide and the sulfone. The third catalyst may include polar functional groups to overcome a bond energy of the carbon-sulfur bond in the sulfoxide and the sulfone. The second catalyst may include a solvent based catalyst including one or more of the following: alcohols and aromatics. The fuel oil may include micro carbons and the second catalyst solubilizes and reforms the micro carbons into soluble alkanes. The third catalyst may include a liquid catalyst including nitrogen, hydrogen, oxygen, copper and carbon.

In block 206, method 200 may include separating, in a vapor recovery unit, the second catalyst from the second mixture to obtain a third mixture. Mixing the first mixture with the second catalyst and the third catalyst can be carried out at a temperature between 75 Fahrenheit and 220 Fahrenheit and a pressure between −20 psig to 20 psig.

In block 208, method 200 may include separating, from the third mixture, in a mechanical separator, the third catalyst, the sulfur, and the oxide of the contaminant to obtain a purified fuel oil. The third catalyst may allow insoluble fractions of the sulfur and the oxide of the contaminant to pass through to the bottom of the mechanical separator. The third catalyst can be immiscible with the fuel oil.

Figure 3:
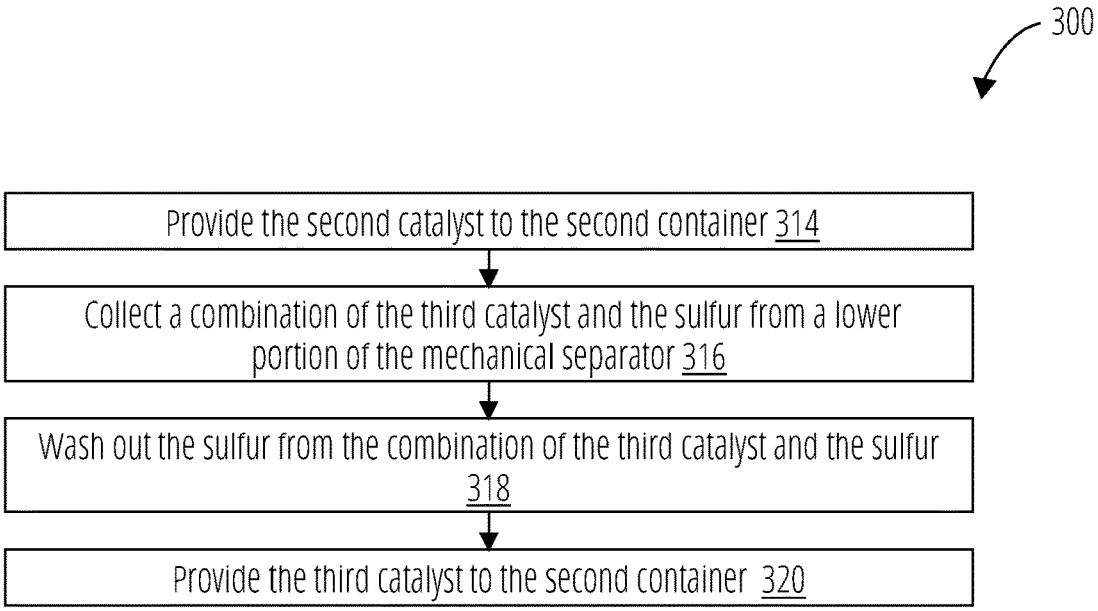
FIG. 3 illustrates an example method for desulfurization and contaminant reduction of fuel oil, according to an example embodiment.

FIG. 3 illustrates an example method 300 for desulfurization and contaminant reduction of fuel oil. The method 300 can be a continuation of the method 200 shown in FIG. 2. Method 300 can be implemented by system 102 shown in FIG. 1. Although example method 300 depicts a particular sequence of operations, the sequence may be altered without departing from the scope of the present disclosure. For example, some of the operations depicted may be performed in parallel or in a different sequence that does not materially affect the function of method 300. In other examples, different components of example system 102 that implements the method 300 may perform functions at substantially the same time or in a specific sequence.

In block 314, method 300 may include providing the second catalyst to the second container.

In block 316, method 300 may include collecting a combination of the third catalyst and the sulfur from a lower portion of the mechanical separator.

In block 318, method 300 may include washing out the sulfur from the combination of the third catalyst and the sulfur.

In block 320, method 300 may include providing the third catalyst to the second container.

Thus, methods for desulfurization and contaminant reduction of fuel oil are disclosed. While the present embodiments have been described in connection with a series of embodiments, these descriptions are not intended to limit the scope of the subject matter to the particular forms set forth herein. It will be further understood that the methods are not necessarily limited to the discrete components described. To the contrary, the present descriptions are intended to cover such alternatives, modifications, and equivalents as may be included within the spirit and scope of the subject matter as disclosed herein and defined by the appended claims and otherwise appreciated by one of ordinary skill in the art.

What is claimed is:

1. A method for desulfurization and contaminant reduction of a fuel oil, the fuel oil being contaminated by a sulfur containing compound and a contaminant, the method comprising:

mixing, in a first container, the fuel oil with a first catalyst, the first catalyst including ozone $O_3$ and poly-hydroxides OH—OH—OH repeated in a chain, to:

oxidize the sulfur containing compound in the fuel oil to obtain one or more of the following: a sulfoxide and a sulfone; and oxidize the contaminant in the fuel oil to obtain an oxide of the contaminant, thereby forming a first mixture, wherein the contaminant is a sulfur-free substance;

mixing, in a second container, the first mixture with a second catalyst and a third catalyst to extract a sulfur and an oxygen from the sulfoxide and the sulfone, thereby obtaining a second mixture;

separating, in a vapor recovery unit, the second catalyst from the second mixture to obtain a third mixture; and separating, from the third mixture, in a mechanical separator, the third catalyst, the sulfur, and the oxide of the contaminant to obtain a purified fuel oil.

2. The method of claim 1, further comprising after separating the second catalyst, providing the second catalyst from the vapor recovery unit to the second container.

3. The method of claim 1, further comprising collecting, in a third container, a combination of the third catalyst and the sulfur from a lower portion of the mechanical separator.

4. The method of claim 3, further comprising washing out the sulfur from the combination of the third catalyst and the sulfur.

5. The method of claim 4, further comprising providing the third catalyst from the third container to the second container.

6. The method of claim 1, wherein:

the second catalyst weakens a carbon-sulfur bond in the sulfoxide and the sulfone; and the third catalyst includes polar functional groups to overcome a bond energy of the carbon-sulfur bond in the sulfoxide and the sulfone.

7. The method of claim 1, wherein:

the second catalyst includes a solvent based catalyst including one or more of the following: alcohols and aromatics; and the third catalyst includes a liquid catalyst including nitrogen, hydrogen, oxygen, copper, and carbon.

8. The method of claim 1, wherein the first catalyst includes a solution of hydrogen, nitrogen, and oxygen.

9. The method of claim 1, wherein the sulfur containing compound includes R'—S—R", at least one of R' and R" including one of the following: organic sulfide and a thiophanic compound.

10. The method of claim 1, wherein:

the contaminant includes one of the following: a silica, a soluble iron, an aluminum, a vanadium, a nickel, and a zinc; and the oxide of the contaminant includes one of the following: a silicon dioxide, an iron oxide, an aluminum oxide, a vanadium pentoxide, a nickel oxide, and a zinc oxide.

11. The method of claim 1, wherein the third catalyst allows insoluble fractions of the sulfur and the oxide of the contaminant to pass through to a bottom of the mechanical separator.

12. The method of claim 1, wherein the third catalyst is immiscible with the fuel oil.

13. The method of claim 1, wherein the fuel oil includes micro carbons and the second catalyst solubilizes and reforms the micro carbons into soluble alkanes.

14. The method of claim 1, wherein the mixing the first mixture with the second catalyst and the third catalyst is carried out at a temperature between 75 Fahrenheit and 220 Fahrenheit and a pressure between −20 pounds per square inch gauge (psig) to 20 psig.

15. A system for desulfurization and contaminant reduction of a fuel oil, the fuel oil being contaminated by a sulfur containing compound and a contaminant, the system comprising:

a first container designed for mixing the fuel oil with a first catalyst, the first catalyst including ozone $O_3$ and poly-hydroxides OH—OH—OH repeated in a chain, to:

oxidize the sulfur containing compound in the fuel oil to obtain one or more of the following: a sulfoxide and a sulfone; and oxidize the contaminant in the fuel oil to obtain an oxide of the contaminant, thereby forming a first mixture, wherein the contaminant is a sulfur-free substance;

a second container designed for mixing the first mixture with a second catalyst and a third catalyst to extract a sulfur and an oxygen from the sulfoxide and the sulfone, thereby obtaining a second mixture;

a vapor recovery unit designed for separating the second catalyst from the second mixture to obtain a third mixture; and a mechanical separator designed for separating, from the third mixture, the third catalyst, the sulfur, and the oxide of the contaminant to obtain a purified fuel oil.

16. The system of claim 15, wherein after being separated from the second mixture, the second catalyst is provided to the second container.

17. The system of claim 15, further comprising a third container designed to store a combination of the third catalyst and the sulfur, the combination being collected from a lower portion of the mechanical separator.

18. The system of claim 17, wherein the sulfur is washed out from the combination of the third catalyst and the sulfur, thereby leaving solely the third catalyst in the third container.

19. The system of claim 18, wherein the third catalyst stored in the third container is provided to the second container.

20. The system of claim 15, wherein:

the second catalyst weakens a carbon-sulfur bond in the sulfoxide and the sulfone; and the third catalyst includes polar functional groups to overcome a bond energy of the carbon-sulfur bond in the sulfoxide and the sulfone.

* * * * *